United States Patent [19]

Ichitsubo et al.

[11] Patent Number: 5,006,080

[45] Date of Patent: Apr. 9, 1991

[54] ELECTRICAL CONNECTOR

[75] Inventors: Norio Ichitsubo; Keishi Sugiyama, both of Yao, Japan

[73] Assignee: Hosiden Electronics Co., Ltd., Yao, Japan

[21] Appl. No.: 535,526

[22] Filed: Jun. 11, 1990

[30] Foreign Application Priority Data

Jun. 21, 1989 [JP] Japan ..... 1-72694[U]

[51] Int. Cl.[5] ..... H01R 23/70

[52] U.S. Cl. ..... 439/634; 439/631

[58] Field of Search ..... 439/59–62, 439/630–637, 638, 746–749, 871, 872, 607, 609

[56] References Cited

U.S. PATENT DOCUMENTS

| | | | |
|---|---|---|---|
| 3,858,163 | 12/1974 | Goodman et al. | 439/634 |
| 4,226,496 | 10/1980 | Langham | 439/746 |
| 4,232,924 | 11/1980 | Kline et al. | 439/629 |
| 4,660,920 | 4/1987 | Shibano | 439/631 |
| 4,715,820 | 12/1987 | Andrews, Jr. et al. | 439/59 |
| 4,915,636 | 4/1990 | Knight | 439/620 |

*Primary Examiner*—Neil Abrams

*Attorney, Agent, or Firm*—Jones, Tullar & Cooper

[57] ABSTRACT

The electrical connector in accordance with the present invention may be connected to, for example, other connector mounted on a circuit board of a machine. This electrical connector is provided at one end of the housing thereof with a board connection space into or from which a circuit board incorporated in a game cassette or the like may be inserted or removed. This electrical connector is provided at the other end of the housing thereof with a connector connection portion into or from which said other connector is adapted to be inserted or removed. Thin plate-like contact members extending over the board connection space and the connector connection portion are inserted from the side of the connector connection portion into the housing of this electrical connector. The contact members are provided at the base ends thereof with transversely turned projecting pieces. By applying a punch to the projecting pieces, the contact members may be readily pushed into the housing without the contact members damaged.

15 Claims, 7 Drawing Sheets

ELECTRICAL CONNECTOR

BACKGROUND OF THE INVENTION

1. Field of the Invention

The present invention relates to an electrical connector to be attached to or removed from other connector mounted on a circuit board (hereinafter referred to as a board-mounted connector). Such an electrical connector may be used as an adapter for the board-mounted connector.

For example, when a circuit board incorporated in a game cassette is directly inserted in or removed from a board-mounted connector mounted on a circuit board of a machine, such insertion and removal are highly frequently made. This leads to a premature expiration of the lifetime of the board-mounted connector. To overcome such a problem, an electrical connector may be mounted, as an adapter, on a board-mounted connector and the circuit board of a game cassette may be inserted into or removed from this electrical connector. When it is found impossible to further use the electrical connector, this electrical connector may be replaced. Thus, the frequency in insertion in and removal from the board-mounted connector is considerably reduced, enabling the board-mounted connector to be protected.

2. Description of the Invention

As the electrical connector to be used in the manner above-mentioned, there is known an electrical connector C' shown in FIG. 10'.

The electrical connector C' has a housing 200 made of an insulating material. The housing 200 includes, at one end thereof, a board connection space S1' into or from which a circuit board P1 of, for example, a game cassette is inserted or removed, and, at the other end thereof, a connector connection space S2' into or from which a board-mounted connector C1' is inserted or removed. The housing 200 incorporates thin plate-like contact members 300 extending over the board connection space S1' and the connector connection space S2.

As shown in FIG. 11, each of the contact members 300 has a wide flat plate-like intermediate portion 310, and narrow resilient contact portions 320, 330 respectively formed at both ends of the intermediate portion 310. The contact portion 320 extends toward the board connection space S1', while the contact portion 330 extends toward the connector connection space S2'. The contact portions 320, 330 have contacts 321, 331, respectively. The contact portion 320 is provided at the tip thereof with a wide engagement portion 322. The intermediate portion 310 has a cut-raised engagement pawl 340. This engagement pawl 340 is engaged with a stand-like engagement portion 210 projectingly formed on the inner peripheral wall of the housing 200.

As shown in FIG. 10, when the board-mounted connector C1' is inserted into the connector connection space S2' of the electrical connector C' having the arrangement above-mentioned, the contact portions 330 are pushed and resiliently deformed by contact pieces 400 formed on the surface of the board-mounted connector C1'. That is, the contacts 331 of the contact portions 330 are pressingly contacted with terminal portions 410 of the contact pieces 400, causing the contact members 300 to be electrically conencted to the contact pieces 400.

When the circuit board P1 of, for example, a game cassette is inserted into the board connection space S1' of the electrical connector C', the contact portions 320 are pushed and resiliently deformed by external terminals (not shown) disposed on the surface of the circuit board P1. The contacts 321 of the contact portions 320 resiliently come in contact with the external terminals of the circuit board P1, causing the contact members 300 to be electrically connected to the circuit board P1.

In the electrical connector C' in FIG. 10 having the arrangement above-mentioned, the contact members 300 are inserted from the connector connection space S2' into the housing 200, and then assembled therein.

However, the contact members 300 are provided at both ends of the intermediate portions 310 with the narrow contact portions 320, 330. Accordingly, the contact portions 320, 330 are apt to be readily deformed when the contact members 300 are inserted into the housing 200.

To minimize such deformation, the contact members 300 may be assembled, for example, in the following manner.

Stepped shoulder portions 350 are formed at the boundary portions of the wide intermediate portions 310 with the narrow contact portions 330, according to the difference in width of the intermediate portions 310 and the contact portions 330. Accordingly, a thin punch may be first applied to the shoulder portions 350. Then, the contact members 300 are pushed from the side of the connector connection space S2' into the housing 200 by the punch. At this time, the contact members 300 are pushed while both lateral edges of the wide engagement portion 322 at the tips of the contact portions 320 slidingly come in contact with shoulder portions 260 formed in the housing 200. When the engagement pawls 340 are engaged with the engagement portions 210, the assembling is complete.

With the assembling procedure above-mentioned, it may be possible to avoid the deformation of the contact portions 320, 330. However, such assembling requires the application of a slender punch to the shoulder portions 350 of which spaces are extremely limited. This involves the likelihood that the shoulder portions 350 and/or the punch are deformed, or that the punch is broken in the worst case.

SUMMARY OF THE INVENTION

In view of the foregoing, the present invention is proposed with the object of providing an electrical connector arranged such that contact members may be incorporated in the housing without the contact members deformed.

It is another object of the present invention to provide an electrical connector which may be assembled in a simple manner, thus improving the productivity.

It is a further object of the present invention to provide an electrical connector which may be connected to other connector of the type in which the contacts of contact pieces are disposed on the surface of the main body.

It is still another object of the present invention to provide an electrical connector which may be connected to other connector of the type in which the contacts of contact pieces are disposed in the housing of the electrical connector.

It is a still further object of the present invention to provide an electrical connector which may be shielded and which may also shield other connector connected to the electrical connector.

To achieve the objects above-mentioned, the electrical connector in accordance with an embodiment of the present invention includes:

a housing made of an insulating material;

a board connection space which is formed at one end of the housing, and into or from which a circuit board is adapted to be inserted or removed;

a connector connection portion which is formed at the other end of the housing, and into or from which other connector is adapted to be inserted or removed; and thin plate-like contact members extending over the connector connection portion and the board connection space.

This electrical connector comprises:

resilient contact portions formed at the tips of the contact members disposed in the board connection space and adapted to be resiliently deformed, as pushed, by a circuit board inserted into the board connection space;

contacts formed on the contact portions and adapted to resiliently come in contact with external terminals of the circuit board when the contact portions are resiliently deformed;

flat plate-like terminal portions formed at the longitudinal center portions of the contact members disposed in the connector connection portion and adapted to be pressingly contacted with the contacts of the resilient contact pieces of other connector connected to the connector connection portion when the contact pieces are resiliently deformed as pushed by the terminal portion;

projecting pieces formed by bending the base ends next to the terminal portions of the contact members, such bending being made transversely of the terminal portions; and engagement pawls formed on the contact members for holding, together with the projecting pieces, a portion of the housing.

According to the electrical connector of the present invention having the arrangement above-mentioned, the contact members may be pushed into the housing with a punch applied to the projecting pieces formed at the ends of the contact members. Since the projecting pieces are formed by bending one ends of the terminal portions, sufficient contact areas may be assured between the punch and the projecting pieces. Accordingly, even though a considerably great pushing force is required for simultaneously pushing the contact members in the form of a chain, there is no likelihood that such a great pushing force causes the punch and the projecting pieces to be damaged. Further, the assembling may be facilitated for the same reasons, thus improving the productivity. A portion of the housing is held by and between the projecting pieces and the engagement pawls of the contact members pushed into the housing. Thus, the contact members may be securely fixed to the housing.

The electrical connector in accordance with another embodiment of the present invention comprises, in the electrical connector of the embodiment above-mentioned:

a shield plate for covering the housing and having extending portions for covering other connector when the other connector is connected to a connector connection portion; and resilient contact pieces formed at the extending portions of the shield plate, the resilient contact pieces further projecting from the end surface of the other connector connected to the connector connection portion.

According to the electrical connector having the arrangement above-mentioned, not only the electrical connector itself, but also the other connector may be shielded.

The electrical connector in accordance with a further embodiment of the present invention has a board connection space and a connector connection portion both formed in the housing. This electrical connector may be connected to other connector provided on the surface of the main body thereof with the contacts of contact pieces. In this electrical connector, when provision is made such that the terminal portions of the contact members come in contact with the inner peripheral wall of the housing, the resistance against the pushing force of a punch applied to the projecting pieces.

According to the electrical connector in accordance with still another embodiment of the present invention, a board connection space is formed in the housing while a connector connection portion is formed outside of the housing. This electrical connector may be connected to other connector having the contacts of contact pieces adapted to be located inside of the housing. In this electrical connector, provision is made such that the contact members have support portions which are formed next to one ends of the terminal portions and which are adapted to come in contact with the inner peripheral wall of the housing, and that contact portions are formed next to U-shape turned portions at the tips of the support portions. In such an arrangement, the resistance against the pushing force of a punch applied to the projecting pieces may be improved.

Other various features and effects of the present invention will be apparent from the following description of embodiments of the present invention.

DETAILED DESCRIPTION OF THE PREFERRED EMBODIMENTS

Figure 1:
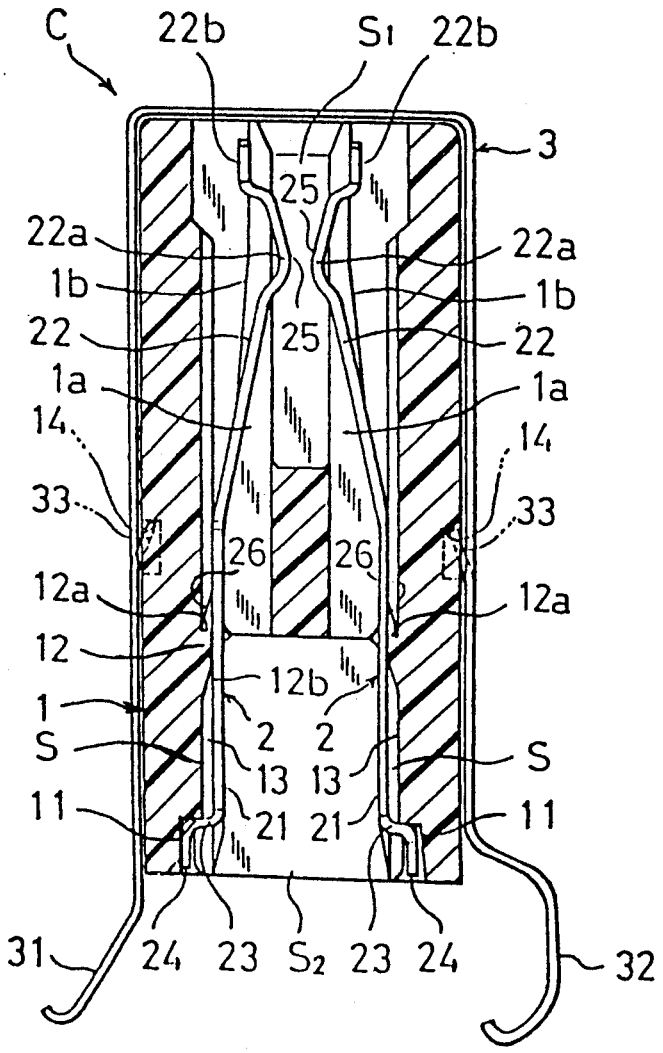
FIG. 1 is an enlarged section view of an electrical connector in accordance with an embodiment of the present invention.

In FIG. 1, an electrical connector C in accordance with the present invention has a housing 1 in the form of a flat box made of an insulating material. The housing 1 incorporates a board connection space S1 which is opened at one end of the housing 1, and a connector connection space S2 which is opened at the other end of the housing 1. Disposed at the opening of the connector connection space S2 is a stepped portion 11 having a greater diameter at the peripheral edge thereof at the opening side. An engagement portion 12 having a trapezoid section is disposed at a position which is separated by a predetermined distance from this stepped portion 11, and which is located in the inner part of the connector connection space S2. The engagement portion 12 has a vertical standing surface 12*a* at the inner side, and an inclined standing surface 12*b* at the front side.

Figure 4:
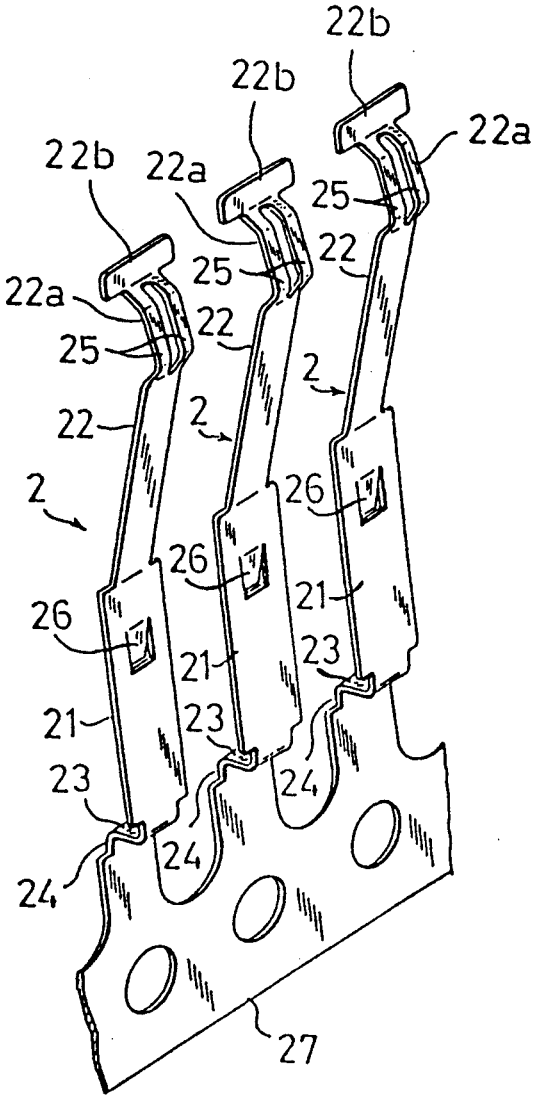
FIG. 4 is a perspective view of contact members in the form of a chain.

The housing 1 incorporates a number of thin plate-like contact members 2, as also shown in FIG. 4, extending over the connector connection space S2 and board connection space S1. The contact members 2 are provided, at the center portions thereof located in the connector connection space S2, with wide plate-like terminal portions 21. The terminal portions 21 are provided, at the tips thereof at the side of the board connection space S1, with narrow contact portions 22 having resiliency. These contact portions 22 extend toward the opening side of the board connection space S1 and are inclined toward the opening center thereof. Tip portions of the contact portions 22 are so curved or bent as to expand toward the center of the housing 1. The apexes of these expanding portions 22*a* form contacts 25. The contact portions 22 are provided at the tips thereof with wide engagement portions 22*b*. The terminal portions 21 are provided, at the other ends thereof, i.e., at the base end portions of the contact members 2, with projecting pieces 23 so bent as to project outside of the terminal portions 21. The projecting pieces 23 are provided at the tips thereof with end pieces 24 extending in the same direction as the extending direction of the terminal portions 21. The terminal portions 21 are provided in the vicinity of the upper ends thereof with engagement pawls 26 formed as cut and raised.

Each of the contact members 2 having the arrangement above-mentioned is disposed in each of a number of grooves la formed in the housing 1. Pairs of opposite contact members 2 are arranged in the thickness direction of the housing 1 as apparent from FIG. 1, while a great number of contact members 2 are arranged, side by side, in two rows in the longitudinal direction of the housing 1 (not shown). The contacts 25 of the contact members 2 project into the board connection space S1. The engagement portions 22*b* are engaged, at both end edges thereof, with shoulder portions 1*b* formed in the housing 1. Slight spaces S are formed between inner surfaces 13 of the housing 1 extending from the stepped portion 11 to the engagement portion 12 and the terminal portions 21 of pairs of contact members 2. The projecting pieces 23 of the contact members 2 are placed above the stepped portions 11, and the engagement pawls 26 are engaged with the inner-side standing surface 12*a* of the engagement portion 12 of the housing 1. Thus, the projecting pieces 23 and the engagement pawls 26 hold a portion of the housing 1 including the inner surfaces 13.

Figure 5:
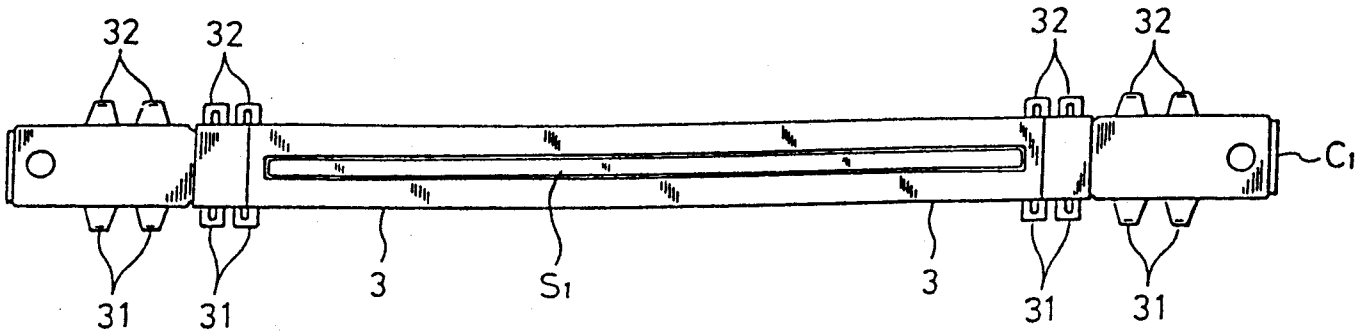
FIG. 5 is a plan view of the electrical connector in FIG. 1 mounted on a board-mounted connector.
Figure 6:
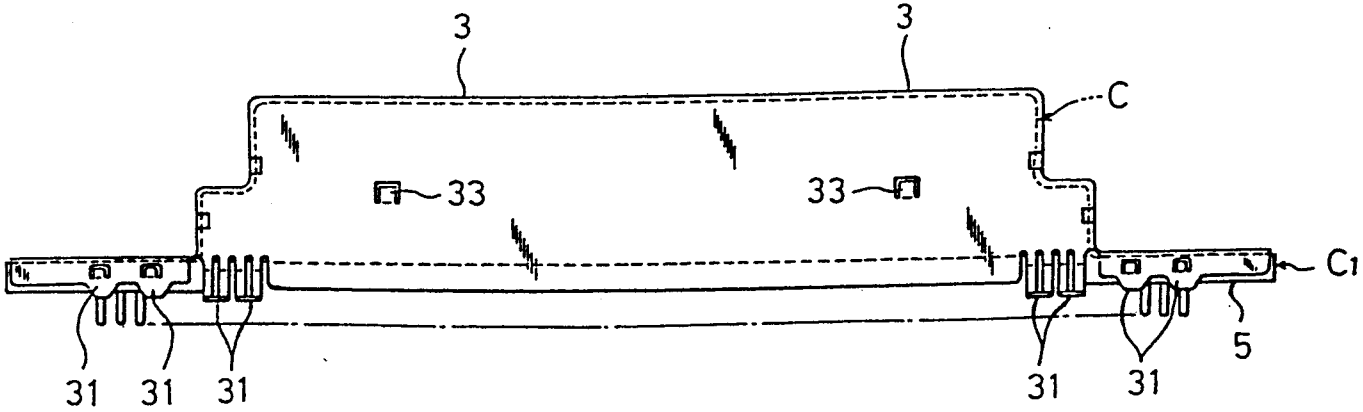
FIG. 6 is a front view of FIG. 5.
Figure 7:
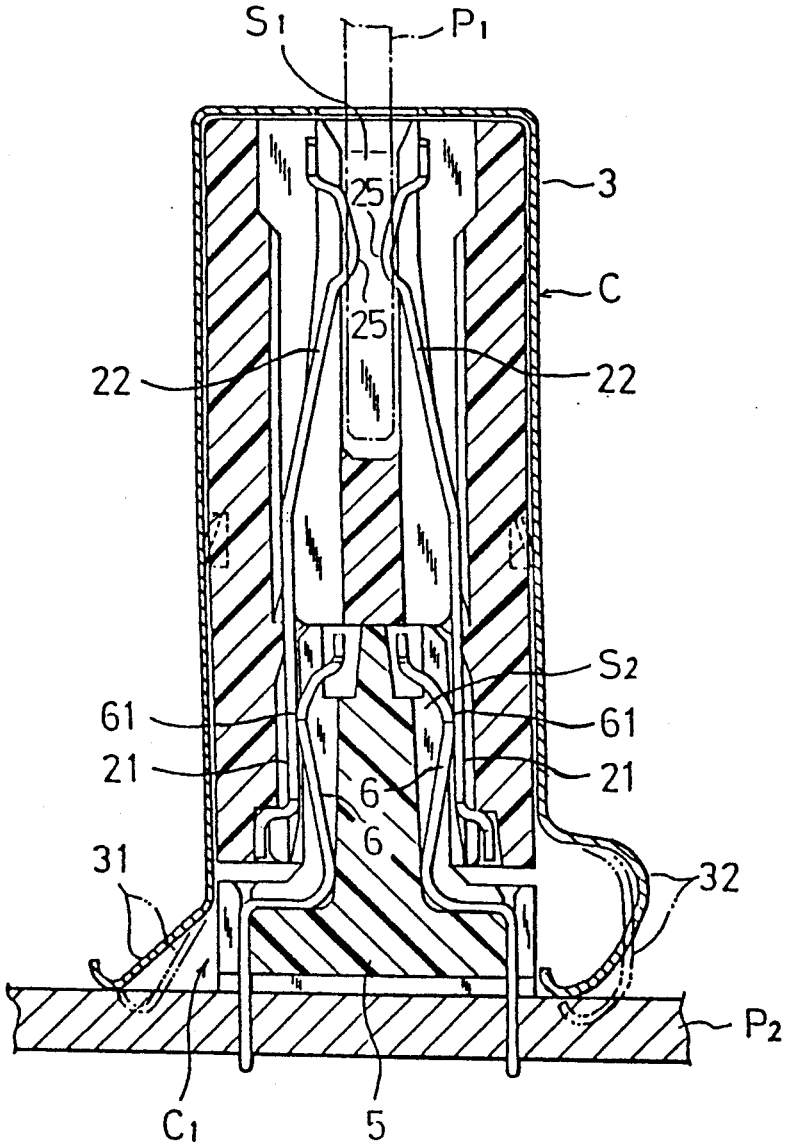
FIG. 7 is an enlarged section view of the electrical connector mounted on a board-mounted connector.

The housing 1 is covered with a shield plate 3 as obtained by bending a metallic plate. When a board-mounted connector C1 is inserted into the connector connection space S2 as shown in FIG. 7, the shield plate 3 so extends from the housing 1 as to cover the body 5 of the board-mounted connector C1. The shield plate 3 is provided at the extending portions thereof with resilient contact pieces 31, 32. Unless resiliently deformed by external factors, the contact pieces 31, 32 further project from the end surface of the body 5 of the board-mounted connector C1 inserted into the connector connection space S2. The contact pieces 31, 32 may be partially formed at the shield plate 3 as shown in FIGS. 5 and 6, or a great number of contact pieces may be arranged side by side throughout the londitudinal sides of the shield plate 3. The shield plate 3 has cut-raised engagement pawls 33, which are engaged with concave portions 14 formed in the outer surface of the housing 1. This enables the shield plate 3 to be secured to the housing 1 such that the shield plate 3 cannot be pulled out from the housing 1.

The following description will discuss the assembling procedure of the contact members 2 with the housing 1.

A great number of contact members 2 in the form of a chain as shown in FIG. 4, are sent to an assembling line.

Figure 2:
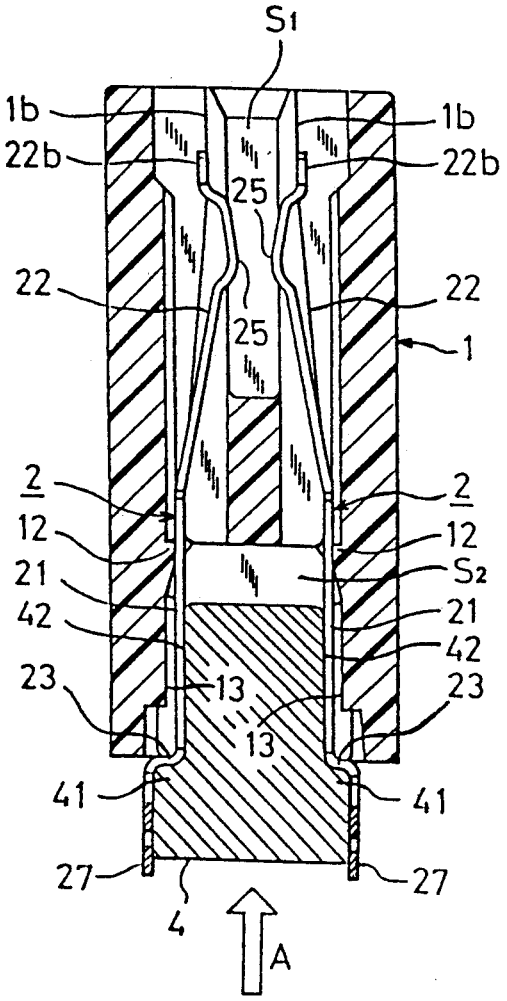
FIGS. 2 and 3 are enlarged section views illustrating how to assemble contact members in a housing.
Figure 3:
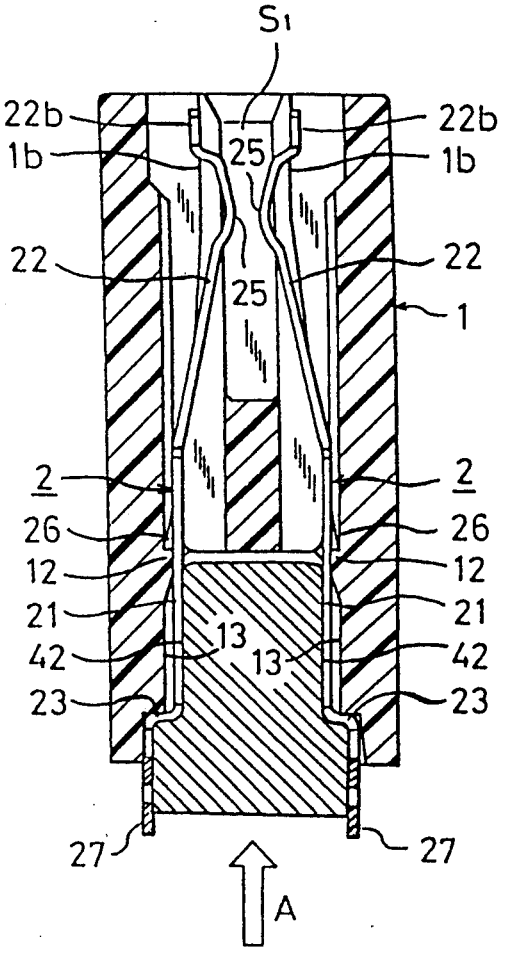

As shown in FIG. 2, shoulder portions 41 of a punch 4 are applied to the projecting pieces 23 of the contact members 2, and the tip-side outer peripheral surface 42 of the punch 4 come in contact with the surfaces of the terminal portions 21 of the contact members 2. In this state, the contact members 2 are pushed into the housing 1 from the connector connection space S2, as shown by an arrow A in FIG. 2. At this time, the contact members 2 are pushed into the housing 1 while the engagement portions 22*b* slidingly come in contact with the shoulder portions 1*b* of the housing 1. Accordingly, the engagement pawls 26 of the contact members 2 get over the engagement portion 12 of the housing 1 and are engaged with the inner-side standing surface 12*a*, as shown in FIG. 3. At the same time, the projecting pieces 23 are placed above the stepped portions 11. That is, a portion of the housing 1 including the inner surfaces 13 is held by and between the engagement pawls 26 and the projecting pieces 23.

After a plurality of contact members 2 in the form of a chain have been pushed into the housing 1 in this manner, tie bars 27 connecting the contact members 2 to one another are then cut, causing the contact members 2 to become independent from one another.

When assembling the contact members 2 in the manner above-mentioned, the pushing force of the punch 4 is received by the projecting pieces 23 of the contact members 2. Sufficient contact areas may be assured between the projecting pieces 23 and the punch 4, and the pushing force is not applied to the resilient contact portions 22. This prevents the contact members 2 from being deformed and also prevents the punch 4 from being broken.

As shown in FIGS. 5 to 7, when the electrical connector C is mounted on the board-mounted connector C1, the shield plate 3 of the electrical connector C covers the body 5 of the board-mounted connector C1, and the contact pieces 31, 32 integral with the shield plate 3 resiliently come in surface contact with a circuit board P2 on which the board-mounted connector C1 is being mounted.

The board-mounted connector C1 is provided at the body 5 thereof with resilient contact pieces 6. The contact pieces 6 have curved-portions expanding in directions away from the body 5, and the apexes of the curved portions form contacts 61. As shown in FIG. 7, when the electrical connector C is mounted on the board-mounted connector C1, the contacts 61 of the contact pieces 6 are pressingly contacted with the terminal portions 21 of the contact members 2, and the terminal portions 21 cause the contact pieces 6 to be resiliently deformed.

When the circuit board P1 is inserted into the board connection space S1 of the electrical connector C, the contact portions 22 are pushed and resiliently deformed outwardly by the circuit board P1. That is, the contacts 25 of the contact portions 22 resiliently come in contact with extermal terminals (not shown) of the circuit board P1.

When mounting the electrical connector C on the board-mounted connector C1, the housing 1 of the electrical connector C may be pushed into the board-mounted connector C1 and the board-mounted connector C1 may be inserted into the connector connection space S2. When removing the electrical connector C from the board-mounted connector C1, the electrical connector C may be upwardly pulled out.

Figure 8:
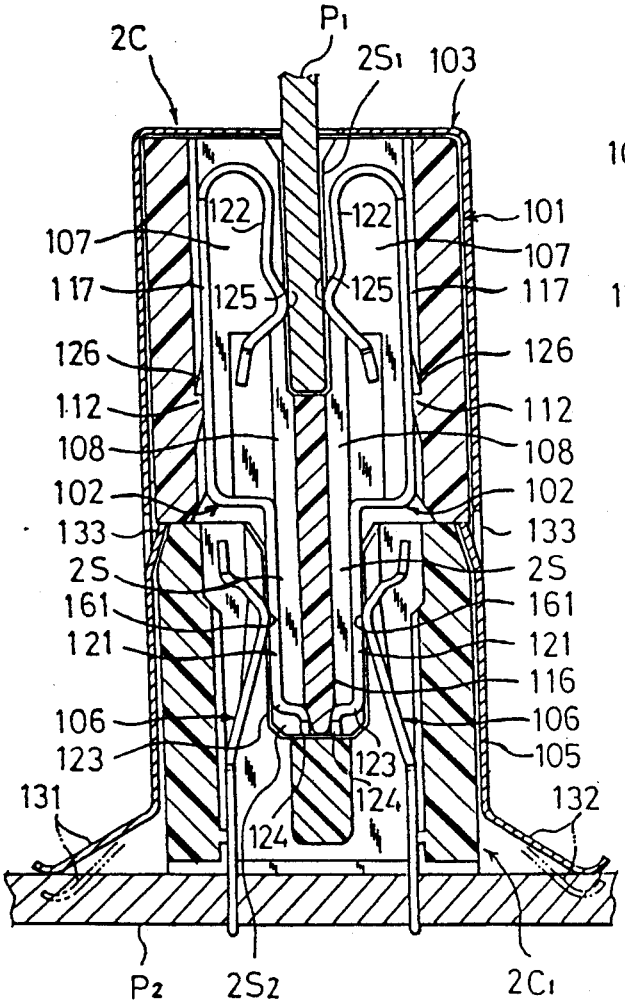
FIG. 8 is an enlarged section view illustrating the electrical connector, as used, in accordance with another embodiment of the present invention.

FIG. 8 shows an electrical connector 2C in accordance with another embodiment of the present invention. The electrical connector 2C has a flat boxtype housing 101 made of an insulating material. The housing 101 incorporates a board connection space 2S1 which is opened at one end of the housing 101. The housing 101 is provided at the other end thereof with a connector connection portion 2S2. Formed in the housing 101 are a plurality of grooves 107 arranged in two parallel rows in the longitudinal direction (i.e., in the direction at a right angle to the drawing plane) so that the grooves of each pair are opposite to each other in the thickness direction. Integrally formed with the housing 101 is a partition wall 116 which extends from the inner end of the board connection space 2S1 to the connector connection portion 2S2 and which partitions the opposite grooves of each pair from each other. This partition wall 116 projects into the connector connection portion 2S2. Integrally formed with the partition wall 116 are partition walls 108 for partitioning the adjacent grooves 107. That is, the partition walls 108 also project into the connector connection portion 2S2. The housing 101 is provided on the inner peripheral surface thereof with an engagement portion 112 having the same arrangement as that of the engagement portion 12 discussed in connection with FIG. 1. The engagement portion 112 is located in the vicinity of the end of the partition wall 116 at the side of the board connection space 2S1.

Mounted on the housing 101 are thin plate-like contact members 102 extending over the connector connection portion 2S2 and the board connection space 2S1. Likewise the contact members 2, the contact members 102 are provided, at the center portions thereof located in the connector connection portion 2S2, with wide flat plate-like terminal portions 121. The terminal portions 121 are provided, at the tips thereof at the side of the board connection space 2S1, with wide support portions 117 which come in contact with the inner walls of the housing 101. U-shape turned portions for imparting resiliency are formed next to the support portions 117, and contact portions 122 are formed as connected to the turned portions. The U-shape turned portions and the contact portions 122 are narrow. Portions of the contact portions 122 are so curved or turned as to expand toward the center of the housing 101. The apexes of such expanding portions form contacts 125. The contact portions 122 are provided at the tips thereof with wide engagement portions **122*a*. The terminal portions 121 are provided at the other ends thereof with projecting pieces 123 which project inwardly of the terminal portions 121. The projecting pieces 123 are provided at the tips thereof with end pieces 124 which extend in the same direction as the extending direction of the terminal portions 121. The support portions 117 have engagement pawls 126 as formed by cutting and outwardly raising portions of the support portions 117, Each of the contact members 102 is disposed in each of the grooves 107. Accordingly, the contact members 102 of each pair are opposite to each other in the thickness direction of the housing 101, and a great number of contact members 102 are arranged in two parallel rows in the longitudinal direction of the housing 101. The contacts 125 of the contact pieces 102 project into the board connection space 2S1. Both end edges of the terminal portions 121 of the contact members 102 come in contact with the partition walls 108. Provision is made such that slight spaces 2S are formed between the partition wall 116 for partitioning the paris of opposite grooves 107 and the center portions of the terminal portions 121 except for both end edges thereof. Both lateral edges of the projecting pieces 123 of the contact members 102 come in contact with the ends of the partition walls 108. The engagement pawls 126 are engaged with the engagement portion 112 of the housing 101. That is, a portion of the housing 101 is held by and between the projecting pieces 123 and the engagement pawls 126**.

The housing 101 is covered with a shield plate 103 as formed by bending a metallic plate. The shield plate 103 so projects from the end surface of the housing 101 as to cover a housing 105 of a board-mounted connector 2C1 when the board-mounted connector 2C1 is connected to the connector connection portion 2S2 as shown in FIG. 8. Resilient contact portions 131, 132 are formed at the portions of the shield plate 103 projecting from the housing 101. The shield plate 103 is secured to the housing 101 by engaging cut-raised engagement pawls 133 of the shield plate 103 with the end surface of the housing 101.

Figure 9:
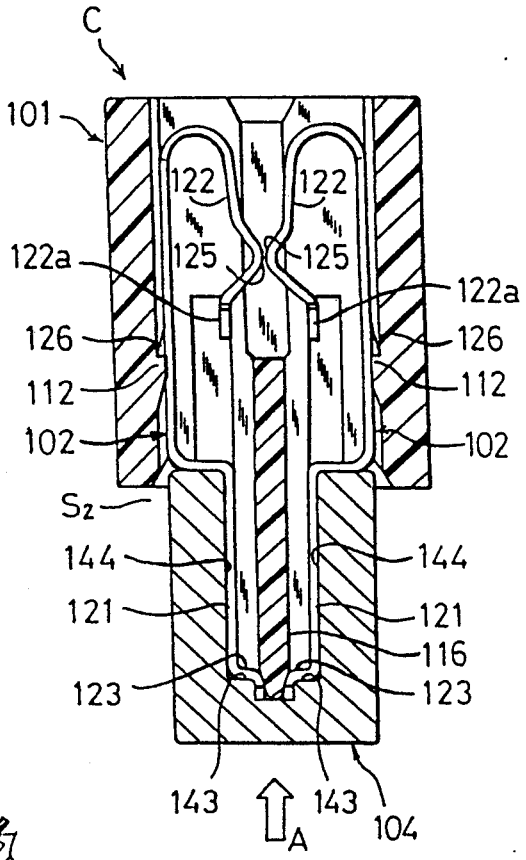
FIG. 9 is an enlarged section view illustrating how to assemble the contact members in a housing.
Figure 10:
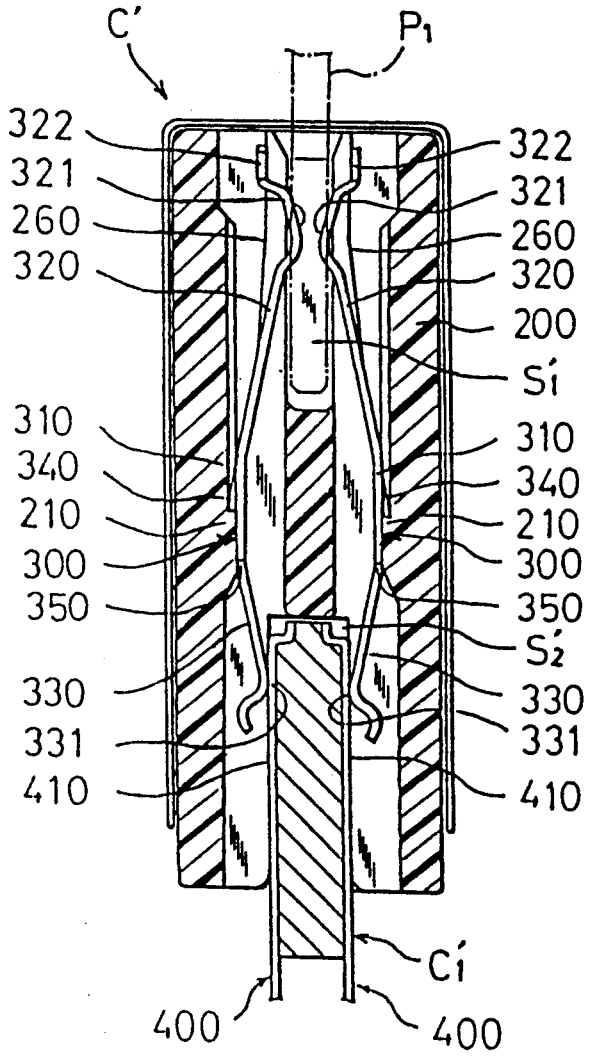
FIG. 10 (PRIOR ART)
FIG. 10 is a longitudinal section view of a conventional electrical connector as used.
Figure 11:
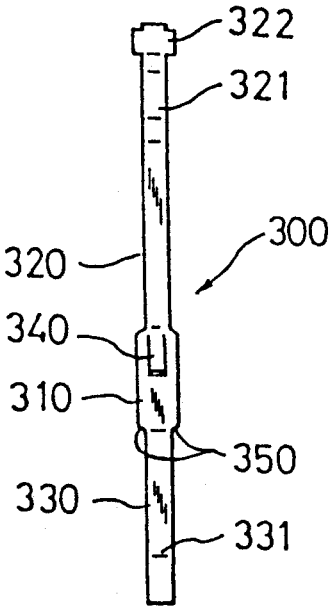
FIG. 11 is a front view of a contact member of the conventional electrical connector in FIG. 10.

The following description will discuss how to assemble the contact members 102 with the housing 101, with reference to FIG. 9.

Likewise the contact members 2 shown in FIG. 4, the contact members 102 are supplied, as connected in the form of a chain, to an assembling line.

As shown in FIG. 9, the terminal portions 121 of the contact members 102 thus supplied to the assembling line are inserted into concave portions of a punch 104 having a U-shape section. The projecting pieces 123 of the contact members 102 are applied to the bottoms of the concave portions of the punch 104. The terminal portions 121 of the contact members 102 come in contact with the inner wall 144 of the punch 104. In this state, the contact portions 122 of the contact members 102 are pushed into the housing 101 from the side of the connector connection space 2S2. The contact portions 122 are pushed into the housing 101 while the engagement portions **122*a* formed at the tips of the contact members 102 slidingly come in contact with the partition walls 108. Accordingly, the engagement pawls 126 of the contact members 102 are engaged with the engagement portion 112 of the housing 101 and the projecting pieces 123 come in contact with the ends of the partition walls 108. A portion of the housing 101 is held by and between the engagement pawls 126 and the projecting pieces 123**.

After a plurality of contact members 102 in the form of a chain have been pushed into the housing 101 in this manner, tie bars connecting the contact members 102 to one another are then cut, causing the contact members 102 to become independent from one another.

When assembling the contact members 102 in the manner above-mentioned, the pushing force of the punch 104 is received by the projecting pieces 123. The pushing force is not applied to the resilient contact portions 122. This prevents the contact members 102 from being deformed and also prevents the punch 104 from being broken.

The board-mounted connector 2C1 is provided in the housing 105 thereof with the contact pieces 106. The contact pieces 106 are provided with expanded curved portions. The apexes of the curved portions form contacts 161.

As shown in FIG. 8, when the electrical connector 2C is mounted on the board-mounted connector 2C1, the contacts 161 of the contact pieces 106 resiliently come in contact with the terminal portions 121. When a circuit board P1 is inserted into the board connection space 2S1 of the electrical connector 2C, the contact portions 122 projecting from the housing 101 are pushed and resiliently deformed by the circuit board P1. Accordingly, the contacts 125 of the contact portions 122 resiliently come in contact with extermal terminals (not shown) of the circuit board P1.

When mounting the electrical connector 2C on the board-mounted connector 2C1, the terminal portions 121 of the contact members 102 may be inserted into the board-mounted connector 2C1, together with the partition wall 116 and the partition walls 108 which project from the housing 101. When removing the electrical connector 2C from the board-mounted connector 2C1, the electrical connector 2C may be upwardly pulled out.

What is claimed is:

1. In an electrical connector having:

a housing made of an insulating material;

a board connection space which is formed at one end of said housing, and into or from which a circuit board is adapted to be inserted or removed;

a connector connection portion which is formed at the other end of said housing, and into or from which other connector is adapted to be inserted or removed; and thin plate-like contact members extending over said connector connection portion and said board connection space, said electrical connector comprising:

resilient contact portions formed at the tips of said contact members disposed in said board connection space and adapted to be resiliently deformed, as pushed, by a circuit board inserted into said board connection space;

contacts formed on said contact portions and adapted to resiliently come in contact with external terminals of said circuit board when said contact portions are resiliently deformed;

flat plate-like terminal portions formed at the longitudinal center portions of said contact members disposed in said connector connection portion and adapted to be pressingly contacted with the contacts of resilient contact pieces of other connector connected to said connector connection portion when said contact pieces are resiliently deformed as pushed by the terminal portion;

projecting pieces formed by bending the base ends next to said terminal portions of said contact members, transversely of said terminal portions; and engagement pawls formed on said contact members for holding, together with said projecting pieces, a portion of said housing.

2. An electrical connector according to claim 1, further comprising:

a shield plate for covering the housing and having extending portions for covering other connector as connected to the connector connection portion; and resilient contact pieces formed at said extending portions of said shield plate, said resilient contact pieces further projecting from the end surface of said other connector connected to said connector connection portion.

3. An electrical connector according to claim 1, wherein the board connection space and the connector connection portion are formed inside of the housing.

4. An electrical connector according to claim 3, wherein the terminal portions of the contact members come in contact with the inner peripheral wall of the housing.

5. An electrical connector according to claim 4, wherein the contact portions are extended, as inclined toward the board connection space, from the tips of the terminal portions.

6. An electrical connector according to claim 4, wherein the projecting pieces are outwardly turned from the terminal portions.

7. An electrical connector according to claim 5, wherein the projecting pieces are outwardly turned from the terminal portions.

8. An electrical connector according to claim 1, wherein the board connection space is formed inside of the housing and the connector connection portion is formed outside of said housing.

9. An electrical connector according to claim 8, wherein the connector connection portion has a projecting portion which is formed integrally with the housing and which projects from the end surface of said housing, and the terminal portions of the contact members come in contact with said projecting portion.

10. An electrical connector according to claim 9, wherein the contact members have support portions formed as extended from one ends of the terminal portions, said support portions coming in contact with the inner peripheral wall of the housing, said support portions having contact portions as continuously extended from tip U-shape turned portions thereof.

11. An electrical connector according to claim 9, wherein the projecting pieces are inwardly turned from the terminal portions.

12. An electrical connector according to claim 10, wherein the projecting pieces are inwardly turned from the terminal portions.

13. An electrical connector according to claim 2, wherein the shield plate has housing engagement portions as formed by cutting and raising portions of said shield plate.

14. An electrical connector according to claim 7, wherein the shield plate has housing engagement portions as formed by cutting and raising portions of said shield plate.

15. An electrical connector according to claim 12, wherein the shield plate has housing engagement portions as formed by cutting and raising portions of said shield plate.

* * * * *